US006405873B2

(12) United States Patent
Koike

(10) Patent No.: US 6,405,873 B2
(45) Date of Patent: Jun. 18, 2002

(54) PACKING METHOD AND PACKAGE

(75) Inventor: Motomu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/860,449

(22) Filed: May 21, 2001

Related U.S. Application Data

(63) Continuation of application No. 09/393,968, filed on Sep. 10, 1999, now abandoned.

(30) Foreign Application Priority Data

Sep. 18, 1998 (JP) ..... 10-264990
Mar. 5, 1999 (JP) ..... 11-58815

(51) Int. Cl.[7] ..... B65D 81/02

(52) U.S. Cl. ..... 206/592; 206/594; 206/495.5; 206/320

(58) Field of Search ..... 206/592, 594, 206/591, 320, 459.5, 459.1, 523, 701, 588; 93/472, 474, 156, 157; 220/836, 837

(56) References Cited

U.S. PATENT DOCUMENTS 3,311,231 A 3/1967 English, Jr.
3,580,467 A 5/1971 Pieszak
3,769,741 A 11/1973 Hessler et al.
3,962,469 A 6/1976 Leavens et al.
4,703,161 A 10/1987 McLean
4,840,276 A 6/1989 George
5,040,678 A 8/1991 Lenmark, Sr. et al.
5,307,117 A 4/1994 Harian
5,366,080 A 11/1994 Carstersen et al.
5,515,976 A 5/1996 Moren et al.
5,641,068 A 6/1997 Warner
5,706,951 A 1/1998 Oinuma et al.
5,715,940 A 2/1998 Son
5,779,045 A 7/1998 Yu

FOREIGN PATENT DOCUMENTS

JP 5-7662 2/1993

*Primary Examiner*—Shian Luong
(74) *Attorney, Agent, or Firm*—Oliff & Berridge, PLC

(57) ABSTRACT

The invention provides a packing method using pulp mold which can be easily disposed of and recycled, and which has high mechanical strength. A packing method, wherein a top pad 1, with a recess and a protrusion, and a bottom pad, with a recess and a protrusion, are positioned so as to oppose each other in order to accommodate a delicate item to be protected therebetween. A reinforcing pad, with a protrusion which is brought into contact with the bottom pad, is also used.

16 Claims, 11 Drawing Sheets

PACKING METHOD AND PACKAGE

This is a Continuation of application Ser. No. 09/393,968 filed Sep. 10, 1999 now abandoned. The entire disclosure of the prior application(s) is hereby incorporated by reference herein in its entirety.

BACKGROUND OF THE INVENTION

1. Field of Invention

The present invention relates to a packing method, and package within which an item is packed.

2. Description of Related Art

A packing method using two pads is disclosed in, for example, Japanese Unexamined Utility Model Publication No. 5-7662. As illustrated in FIG. 2 of this document, the protrusion 6*a* is formed so that it can come into contact with a packaging box 10 such as a corrugated cardboard box. In this case, it is true that packing strength is ensured, but shock tends to be transmitted to the packed item, which is particularly not desirable when packing electronic devices such as optical devices or precision instruments.

SUMMARY OF THE INVENTION

Accordingly, the present invention provides a packing method which can overcome the above-described problem present in conventional packing methods, and which allows the use of materials which can be recycled.

There is provided a method of packing an item such that the item is accommodated between a first pad, with a plurality of protrusions and a plurality of recesses, and a second pad, with a plurality of protrusions and a plurality of recesses, wherein a third pad, with a protrusion which can come into contact with at least one of the plurality of recesses of the second pad, is disposed opposite to the first pad with reference to the second pad.

When the protrusion of the third pad is disposed so that it comes into contact with the recess or recesses of the second pad, at least one of the recesses of the second pad does not come into direct contact with the packaging box in which the item is accommodated, and the protrusion of the third pad and the recesses of the second pad can absorb shock to reduce the amount of shock exerted on the packed item compared to that exerted on items packed in conventional packaging boxes.

The protrusion of the third pad may be disposed such that the longitudinal direction thereof is substantially perpendicular to the longitudinal direction of the recesses of the second pad.

When the protrusion is positioned substantially perpendicular to the recesses, instead of in the same direction as the recesses, the area of the protrusion of the third pad which receives the load of the recess or recesses of the second pad becomes narrower, making it possible to ensure deformation of the pads by the required amount. Making the protrusion of the third pad long in the longitudinal direction is more effective in ensuring the required deformation.

The recesses of the second pad may be tapered, and the protrusion of the third pad may be tapered. Tapers make it harder for shock to reach the packed item. The depth of the recesses of the second pad may be substantially equal in value to the height of the protrusion of the third pad. When the depth is made substantially equal in value to the height, it is possible to ensure deformation of the pads by the required amount, thereby increasing the shock absorbing capability of the pads. The pads may be formed of pulp mold or recycled pulp mold. Paper pulp, instead of the conventionally and generally used petroleum chemicals, may be used, thereby facilitating recycling. The use of very firm, recycled pulp, instead of virgin pulp, results in increased pad strength.

DETAILED DESCRIPTION OF PREFERRED EMBODIMENTS

A description will now be given of the invention applied to the packing of an electronic device, with reference to the drawings.

Figure 1:
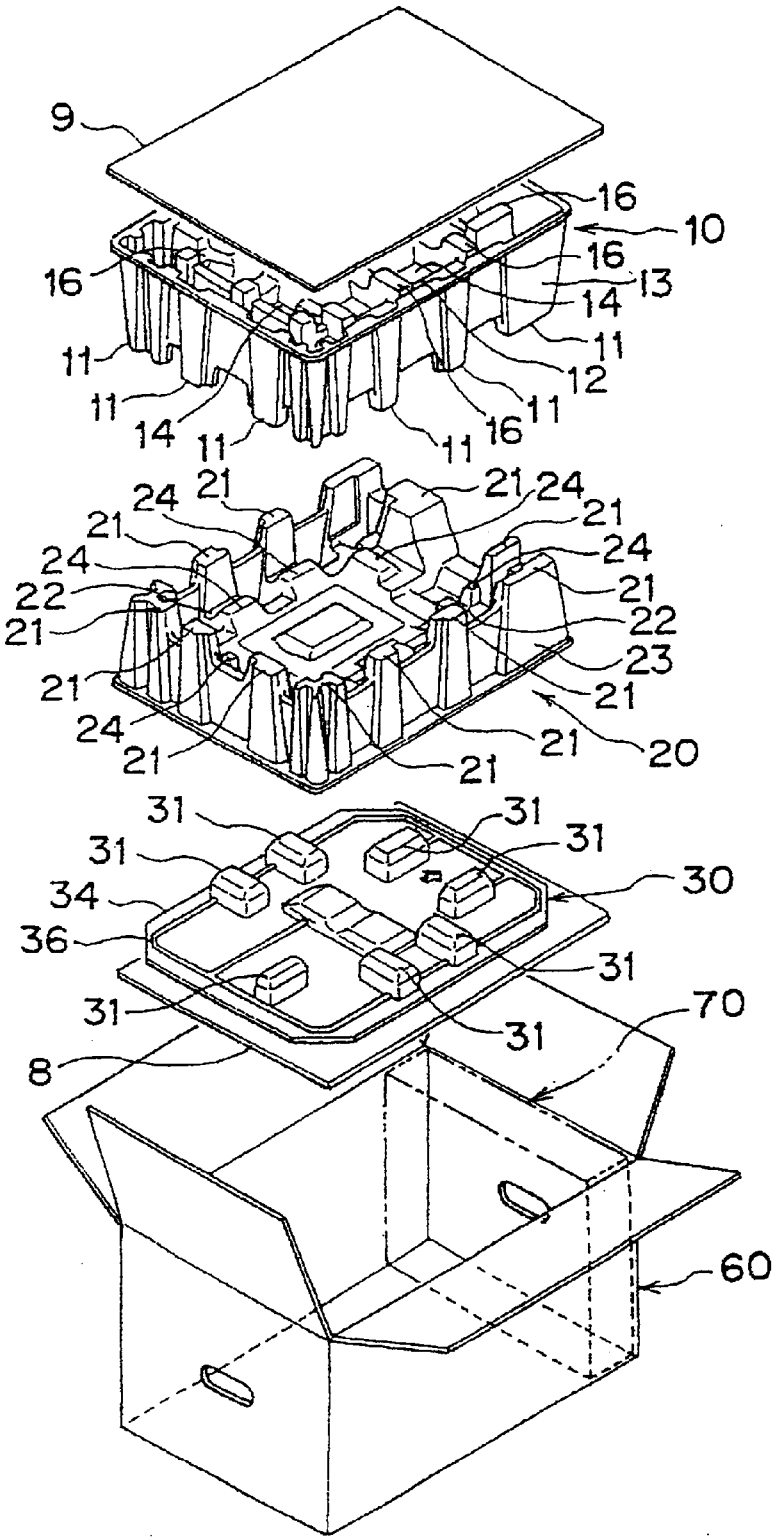
FIG. 1 is a perspective view of the pads and the packaging box (corrugated cardboard box), used to illustrate the present invention.
Figure 2:
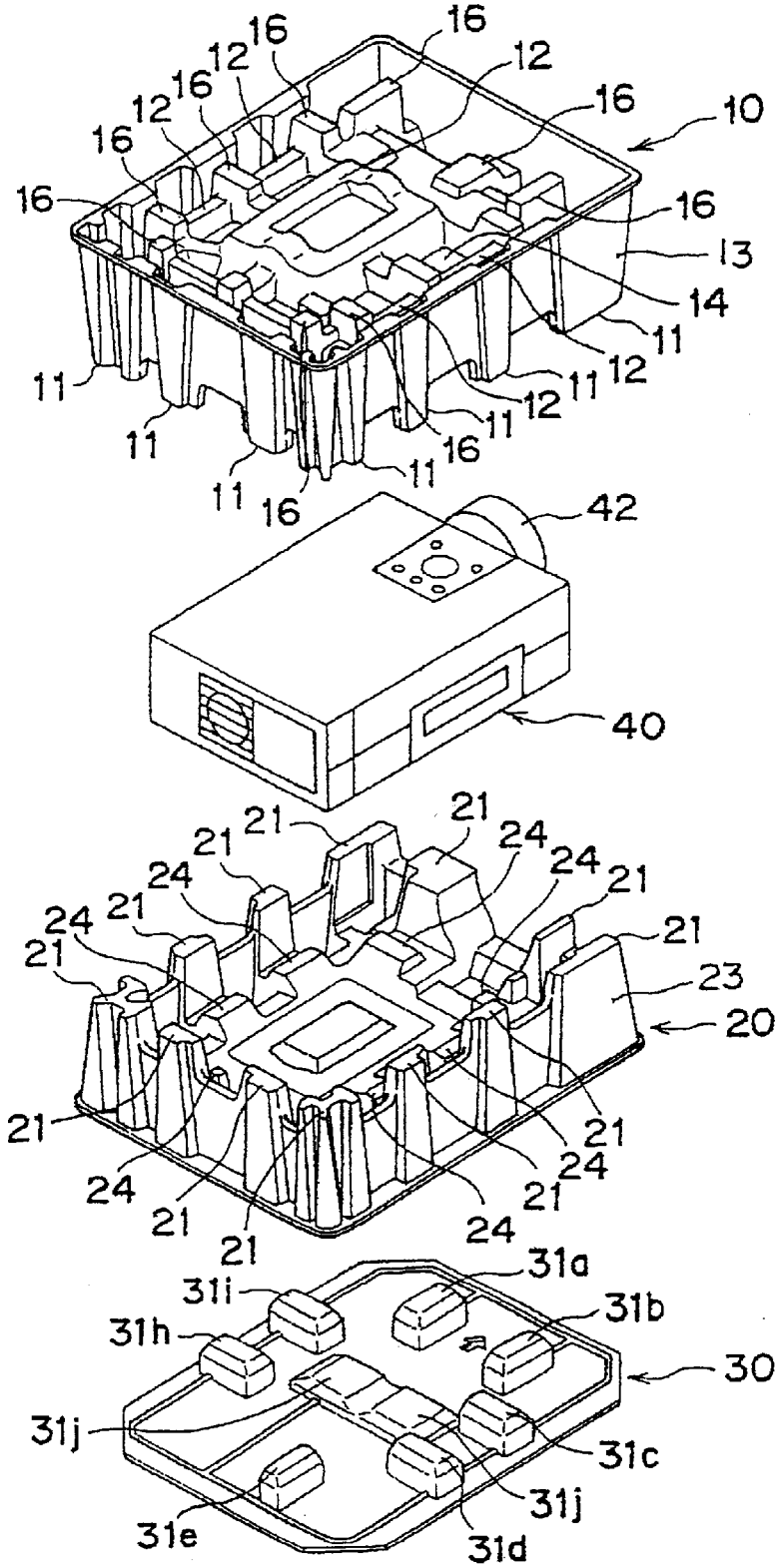
FIG. 2 is a perspective view of the pads and the electronic device, used to illustrate the present invention.
Figure 3:
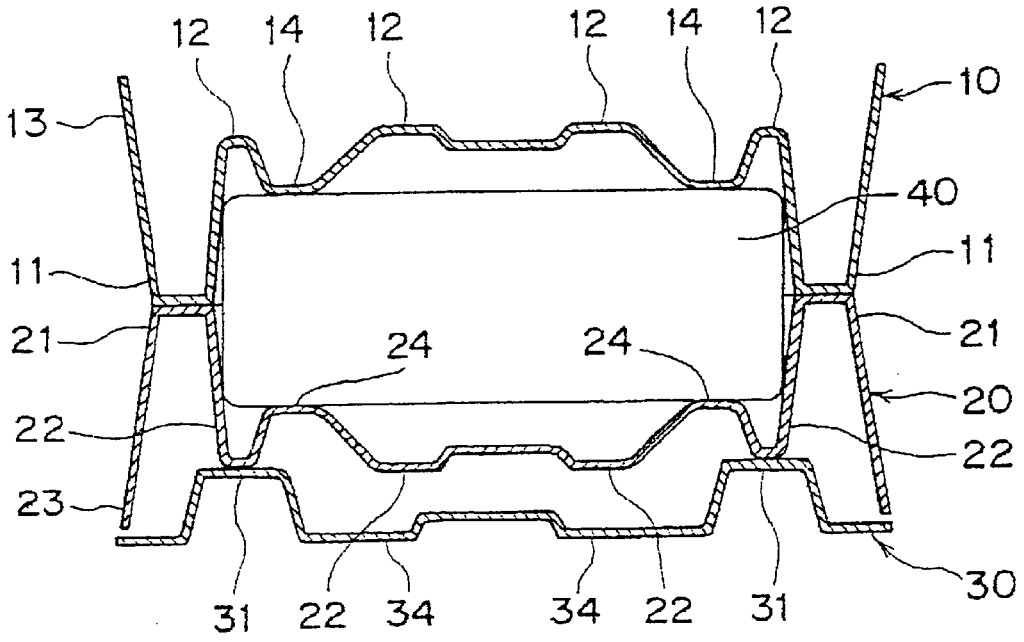
FIG. 3 is a sectional view of the pads within which an item is packed.

As shown in FIGS. 1 to 3, an electronic device (projector), being an item 40 to be packed, is packed by placing a top pad 10 and a bottom pad 20 upon each other so that the protrusions 11 of the top pad 10 and the protrusions 21 of the bottom pad 20 come into contact. As shown in FIGS. 2 and 3, the item 40 is accommodated in the space between the protrusions 11 of the top pad 10 and the protrusions 21 of the bottom pad 20. FIG. 3 is a horizontal sectional view of the center portion where the top pad 10 and the bottom pad 20 are placed upon each other.

The portions of the top pad 10 which come into contact with the top planar surface of the item 40 are called flat portions 14, while the portions of the bottom pad 20 which come into contact with the bottom planar surface of the item 40 are called flat portions 24; and the portions of the top pad 10 which extend from their respective flat portions 14 and which are spaced from the item 40 are called recesses 12, while the portions of the bottom pad 20 which extend from their respective flat portions 24 and which are spaced from the item 40 are called recesses 22. Skirts 13 and 23, provided at the lower portions of their respective protrusions 11 and 21, are formed continuously along the outer periphery of the pads 10 and 20, resulting in increased strength of the respective pads 10 and 20. Ordinarily, the item 40, which has been packed using the top and bottom pads 10 and 20, are accommodated in a packaging box 60, such as a corrugated cardboard box, along with an additional box 70, and then shipped or stored. In FIG. 1, reference numerals 8 and 9 denote corrugated cardboard holding plates.

When the item 40, accommodated in the packaging box 60, is dropped with the bottom surface (the bottom pad 20 side) of the packing item 40 faced downward, and is subjected to external shock, the weight of the item 40 is transmitted to the bottom pad 20 primarily through the flat portions 24. In this case, the recesses 22 of the bottom pad 20, and the skirt 23 below the protrusions 21 get deformed in order to prevent transmission of shock, produced when the packaging box 60 is dropped, to the item 40. Accordingly, they act as shock absorbers. When the pads are formed of pulp mold, or when the item 40 is relatively heavy, the respective pads may break. A possible solution to this problem is to strengthen the pads by forming the protrusions 21 and the recesses 22 without tapers so that their wall surfaces are perpendicular to their respective flat portions 24. However, when the protrusions 21 and the recesses 22 are formed in this manner, the pads tend to resist getting deformed, causing transmission of shock to the item 40, and in worst cases breakage of the item 40.

Therefore, the protrusions 21 and the recesses 22 are formed with tapers so that they are deformed easily, thereby making it difficult for shock to reach the item 40. In addition, a reinforcing pad 30, with protrusions 31 formed at locations which allow them to come into contact with the recesses 22 of the bottom pad 20, is placed between the packaging box 60 and the bottom pad 20 so that shock, produced when the packaging box 60 is dropped, is absorbed by the protrusions 31.

Figure 8:
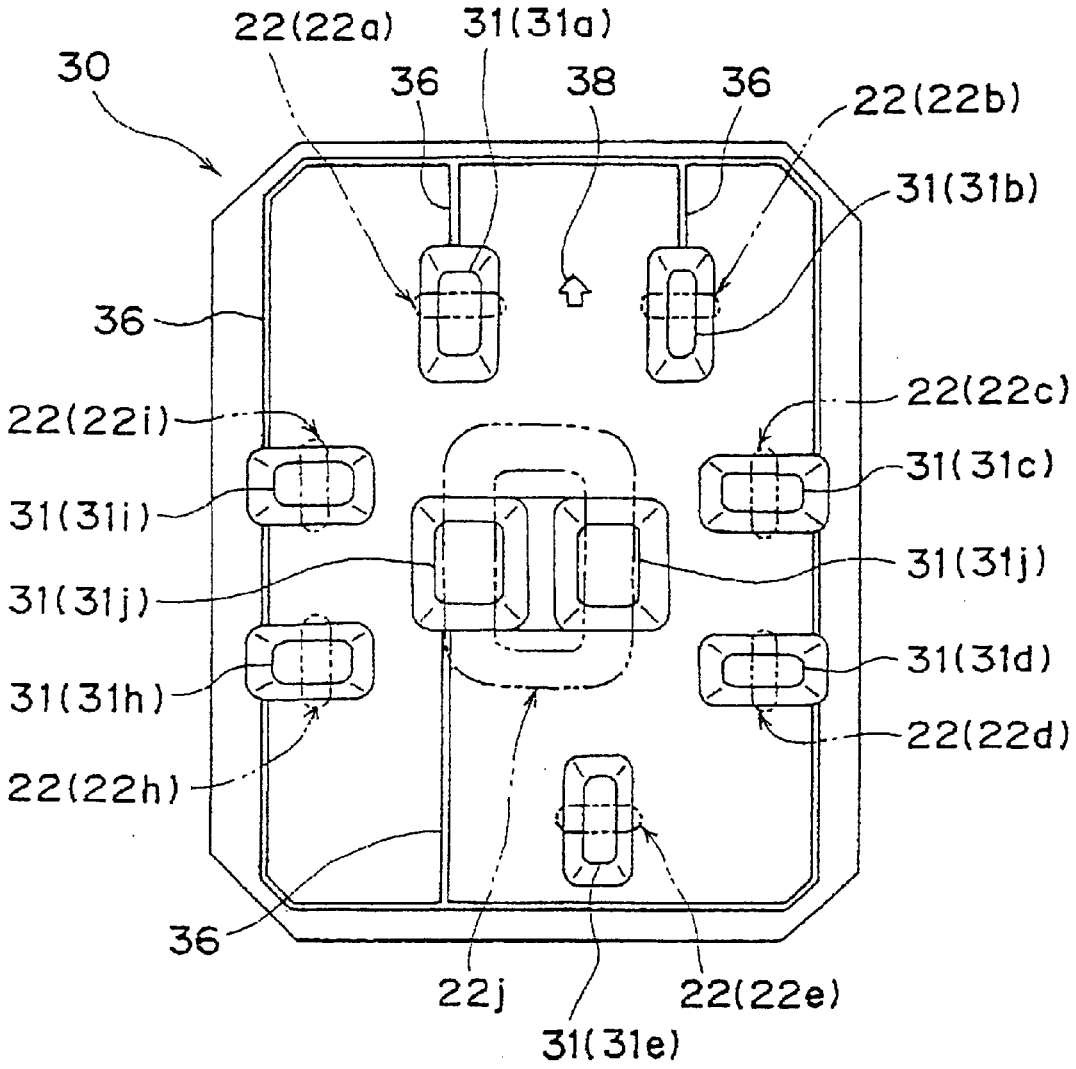
FIG. 8 is a plan view of the reinforcing pad.

The number and size of the protrusions 31 of the reinforcing pad 30 are determined based on the material of the pads 10, 20, and 30, and the weight of the packing item 40. When the recesses 22 have substantially a rectangular shape when viewed in a plane, it is preferable that the protrusions 31 be positioned at substantially right angles to the recesses 22, as shown in FIGS. 1 to 3 and 8, rather than being formed into the same shape as the recesses 22 and being positioned so as to overlap the recesses 22. In the latter case, the protrusions 31 and the recesses 22 become more rigid, so that shock tends to be transmitted to the item 40. In the former case, as shown in FIGS. 3 and 8, the load of each recess 22 is received by a narrow portion of its associated protrusion 31, so that compared to the latter case the protrusions 31 and the recesses 22 become less rigid, thereby reducing the amount of shock. Here, when the depth of each recess 22 (as measured from its associated flat portion 24) and the height of each protrusion 31 (as measured from its associated flat portion 24) are made substantially the same in value, they can be deformed by the greatest amount possible, thereby increasing their capability to function as shock-absorbers.

A description will now be given in more detail of the protrusions, the flat portions, and the recesses of the top and bottom pads 10 and 20, and the protrusions of the reinforcing pad 30, with reference to FIGS. 4 to 8.

The top and bottom pads 10 and 20 are rectangular in shape when viewed in a plane, with protrusions 11 and 21 being formed so as to be disposed at predetermined intervals along the side edges of their respective top and bottom pads 10 and 20.

Figure 4:
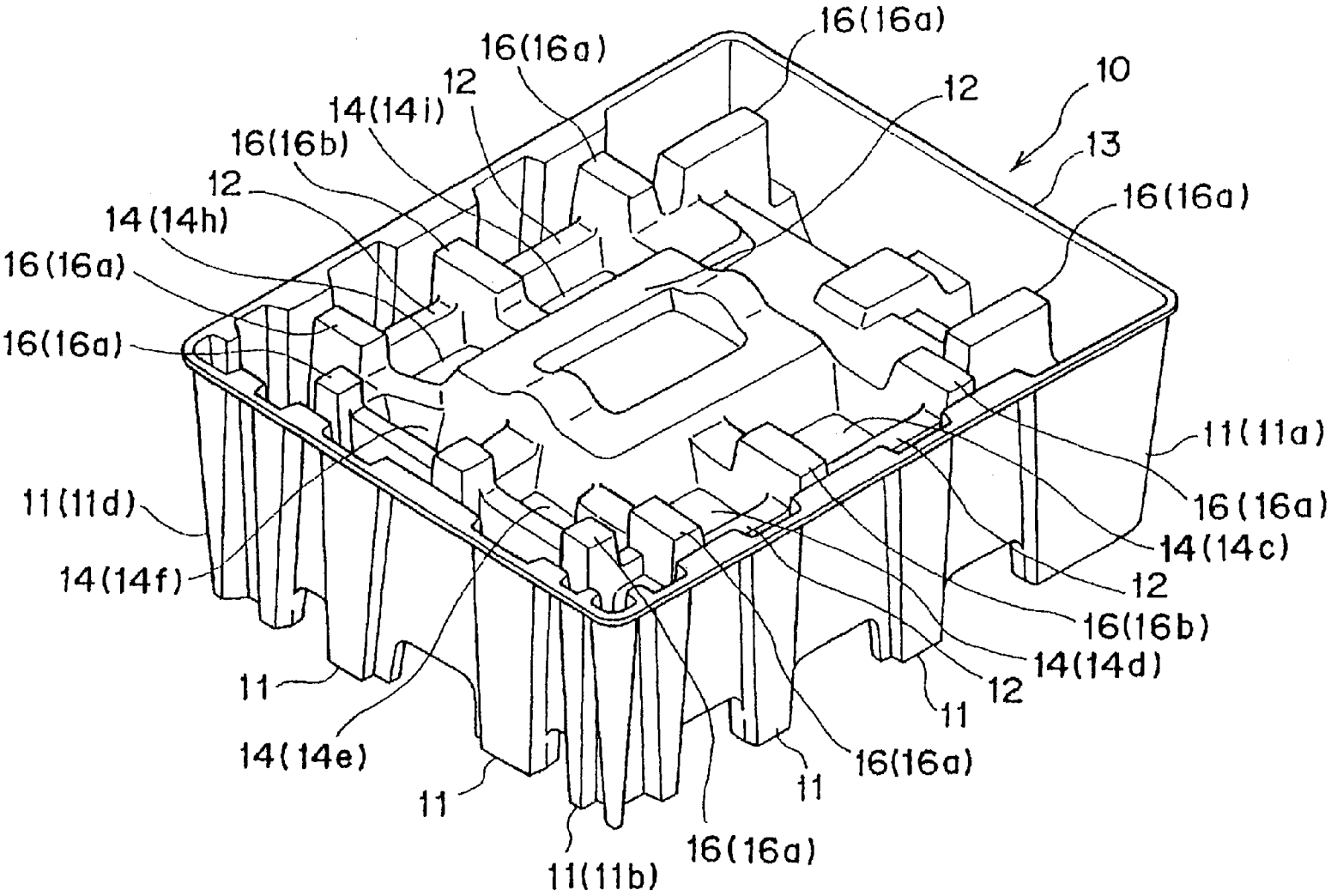
FIG. 4 is a perspective view of the top pad.
Figure 5:
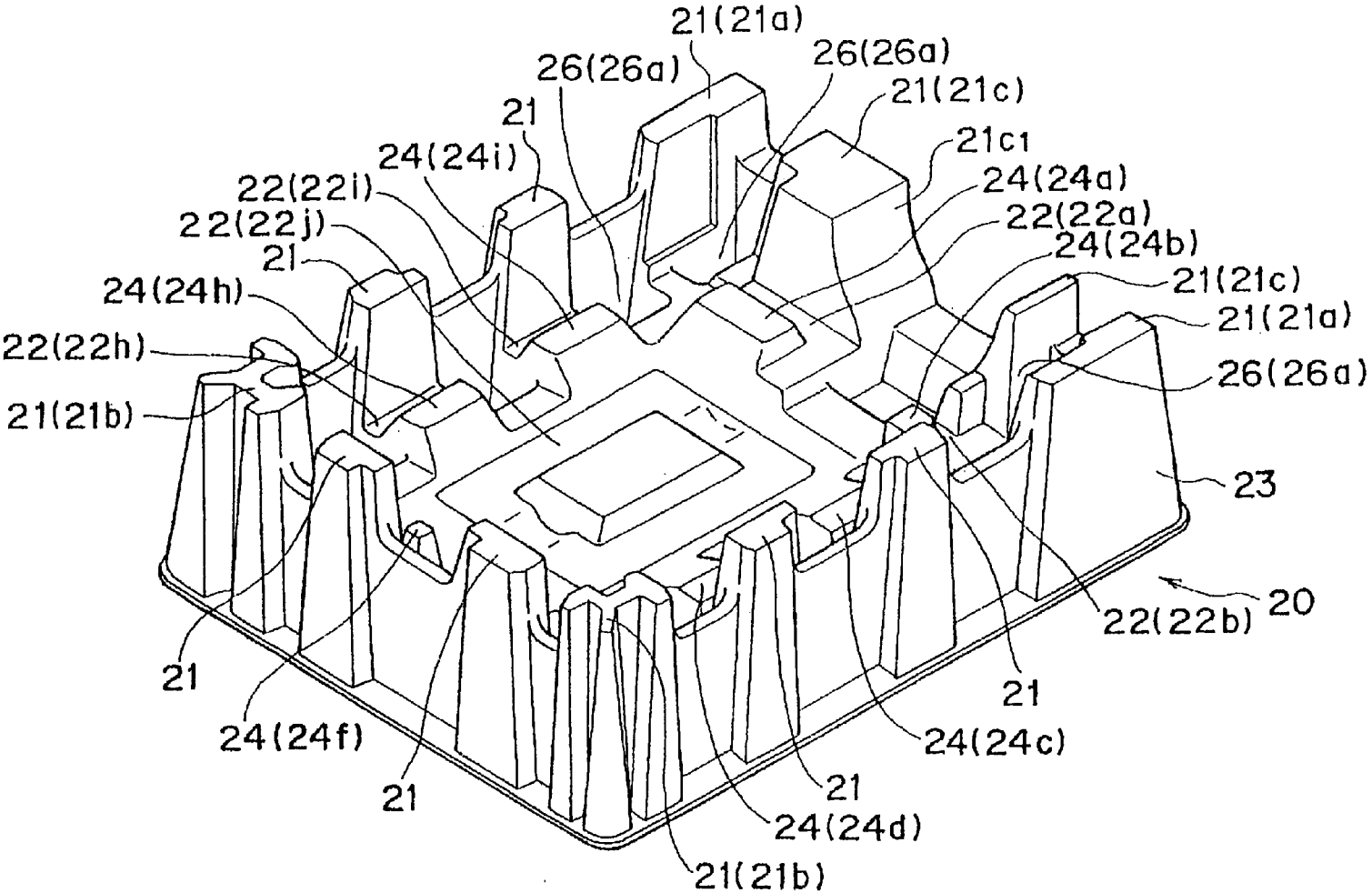
FIG. 5 is a perspective view of the bottom pad.
Figure 6:
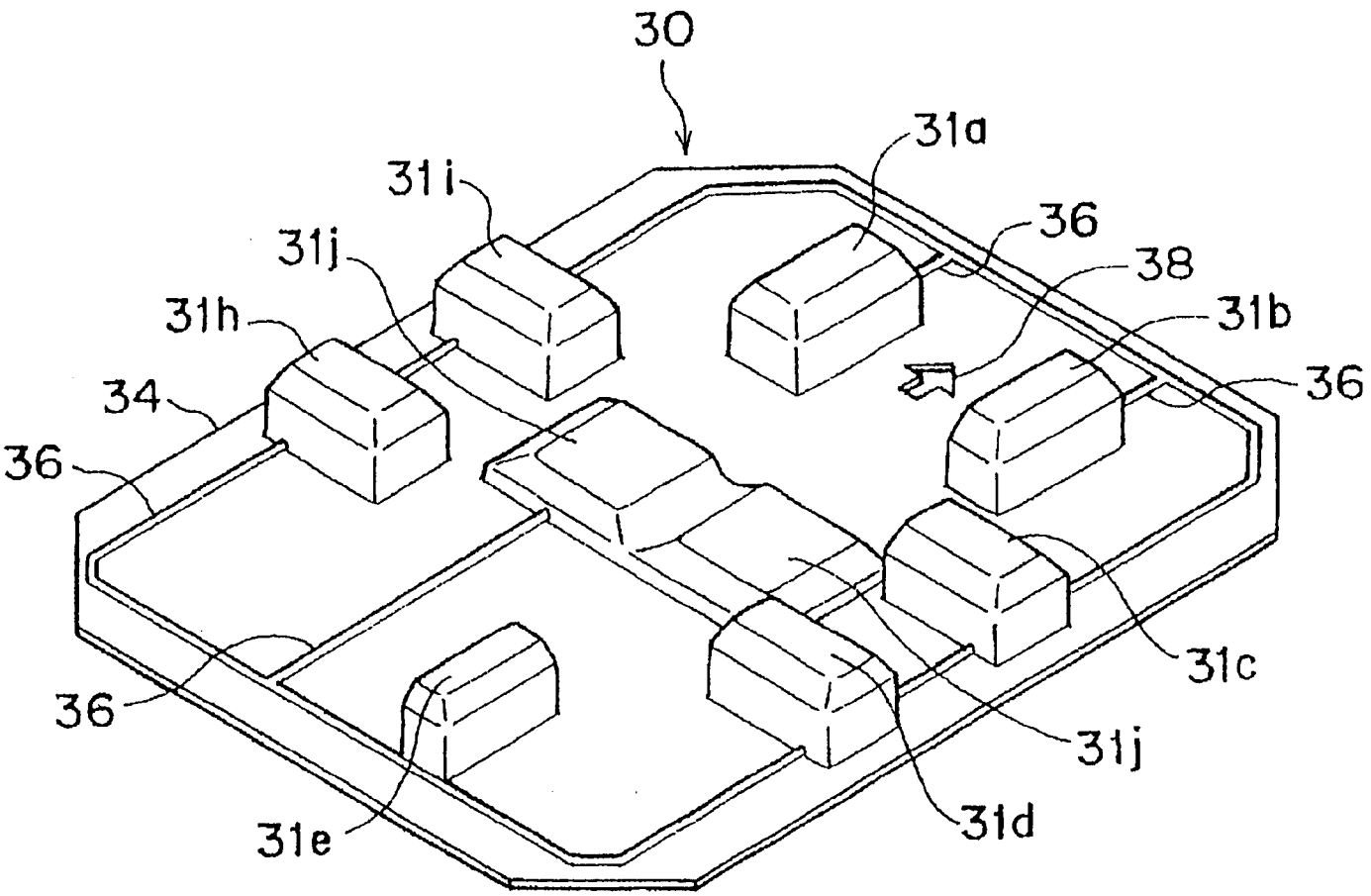
FIG. 6 is a perspective view of the reinforcing pad.
Figure 7:
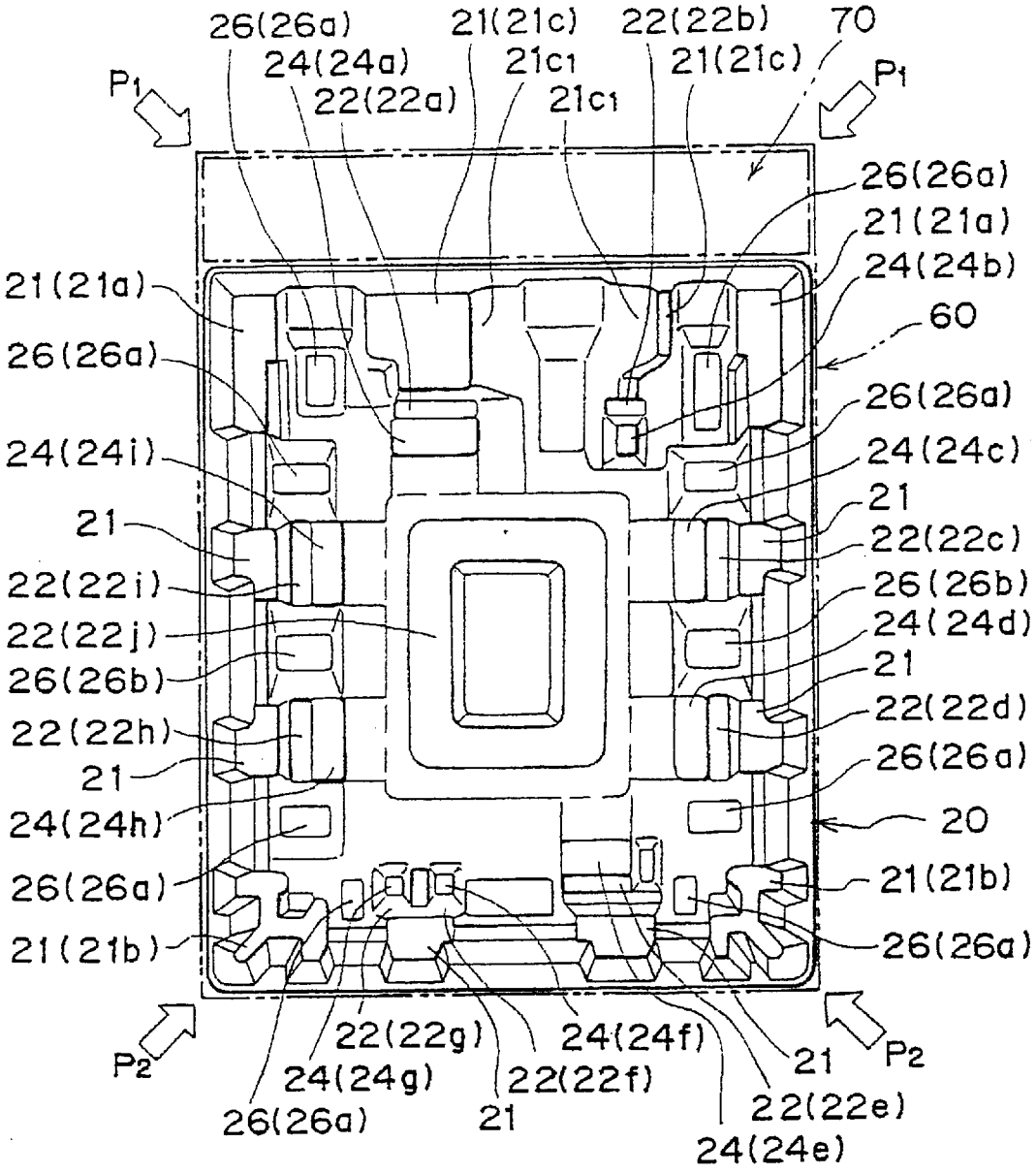
FIG. 7 is a plan view of the bottom pad.

As shown in FIGS. 5 and 7, flat portions 24 (24*a* to 24*i*) are formed inwardly of the protrusions 21 of the bottom pad 20, substantially in correspondence with their respective protrusions 21 and so as to be surrounded by the protrusions 21; and as shown in FIG. 4, flat portions 14 (14*c*, 14*d*, 14*e*, 14*f*, 14*h*, and 14*i*) are formed inwardly of the protrusions 11 of the top pad 10, substantially in correspondence with their respective protrusions 11 and so as to be surrounded by the protrusions 11.

In the bottom pad 20, recesses 22 (22*a* to 22*i*) are formed between their respective flat portions 24 and their respective protrusions 21, with a shallow recess 22*j*, being rectangular when viewed in a plane, being formed at the center of the bottom pad 20.

The recesses 22 (22*a* to 22*i*), which are formed between their respective flat portions 24 (24*a* to 24*i*) and their respective protrusions 21 so as to protrude downward, form ribs which extend along the side edges of the pad 20. The ribs make the entire bottom pad 20 more rigid and thus more resistant to deformation.

Reference numeral 26 (or reference numerals 26*a* and 26*b*) denote deep recesses, or legs, disposed along the locations where the recesses 22, or ribs 22, are formed, with the amount by which they protrude downward being substantially the same in value as the height of the skirt 23.

More specifically, the amount by which the respective recesses 26*a*, disposed near the corners of the bottom pad 20, protrude downward is equal in value to the height of the skirt 23, so that when the bottom pad 20 is placed upon the reinforcing pad 30, the recesses 26*a* come into contact with the flat portion 34 of the reinforcing pad 30, and cooperate with the skirt 23 to support the weight of the item 40.

The amount by which the pair of recesses 26*b*, disposed at substantially the center of the long side of the bottom pad 20, is slightly less in value than the height of the skirt 23 (or the amount by which the recesses 26*a* protrude downward), so that when the bottom pad 20 is placed upon the reinforcing pad 30, the recesses 26*b* are located slightly above the flat portion 34 of the reinforcing pad 30. Therefore, although, unlike the recesses 26*a*, the recesses 26*b* do not directly support the weight of the item 40, they cooperate with the skirt 23 and the recesses 26*a* to absorb the shock produced when the packaging box 60, in which the item 40 is accommodated, is dropped with the bottom pad 20 facing downward.

Similarly with the bottom pad 20, in the top pad 10 shown in FIG. 4, protrusions 12 are formed between the protrusions 11 and the corresponding flat portions 14, and form ribs which make the entire top pad 10 more rigid. Deep recesses 16 (16*a* and 16*b*), or legs, having a depth substantially equal in value to the height of the skirt 13, are formed in correspondence with the deep recesses 26 of the bottom pad 20 in the vertical direction.

A plurality of protrusions 31 (31*a* to 31*e*, 31*h*, and 31*i*) are formed on the flat portion 34 of the bottom surface of the reinforcing pad 30, being rectangular in shape when viewed in a plane like the top and bottom pads 10 and 20, so as to protrude from the flat portion 34. The protrusions 31*a*, 31*b*, 31*c*, 31*d*, 31*e*, 31*h*, and 31*i* are formed in correspondence with the recesses, or ribs, 22*a*, 22*b*, 22*c*, 22*d*, 22*e*, 22*h*, and 22*i* of the bottom pad 20, while the pair of protrusions 31*j* and 31*j* at the center of the flat portion 34 are formed in correspondence with the shallow, center recess 22*j* of the bottom pad 20. When the bottom pad 20 is placed upon the reinforcing pad 30, the recesses 22*a*, 22*b*, 22*c*, 22*d*, 22*e*, 22*h*, 22*i*, and 22*j* of the bottom pad 20 are, as indicated by phantom lines in FIG. 8, positioned so as to be in contact with their respective protrusions 31*a*, 31*b*, 31*c*, 31*d*, 31*e*, 31*h*, 31*i*, and 31*j* of the reinforcing pad 30.

The respective recesses 22 of the bottom pad 20 and the respective protrusions 31 of the reinforcing pad 30 are brought into contact with each other such that the longitudinal direction of the recesses is substantially perpendicular to that of their respective protrusions. The recesses 22 of the bottom pad 20 and the protrusions 31 of the reinforcing pad 30 cooperate with the skirt 23 and the deep recesses 26 of the bottom pad 20 to support the weight of the item 40 and to act as shock absorbers for absorbing the shock produced by the item 40 which has been dropped.

Reference numeral 36 denotes a rib extending primarily along the side edges of the reinforcing pad 30, and acts to increase the rigidity, and thus, to reduce warpage of the entire reinforcing pad 30. Reference numeral 38 denotes an arrow formed between the protrusion 31*a* and the protrusion 31*b,* and is provided on the reinforcing pad 30 to indicate the positioning of the projecting lens of a projector 40.

Reference numeral 21$c_1$ in FIGS. 5 and 7 denotes curved accommodating faces for accommodating the projecting lens of a projector 40. The accommodating faces correspond to the opposing side faces of the protrusions 21*c* provided at substantially the center of a short side of the bottom pad 20. As shown in FIGS. 1, 2, and 7, the projector 40 is accommodated in the packaging box 60 by, in general, packing it within the top and bottom pads 10 and 20 such that the projecting lens 42 faces the additional box 70. Prior to accommodating the projector 40, it is necessary to accommodate the reinforcing pad 30 in the packaging box 60. One cannot tell which of the short sides is the projecting lens positioning side (or additional box 70 accommodating side) by just looking at the reinforcing pad 30. To overcome this problem, the arrow mark 38 is provided on the reinforcing pad 30 to indicate which of the short sides is the projecting lens positioning side, making it possible to prevent the reinforcing pad 30 from being accidentally placed in the packaging box 60 when its projecting lens positioning side is not facing the additional box 70.

Figure 9A:
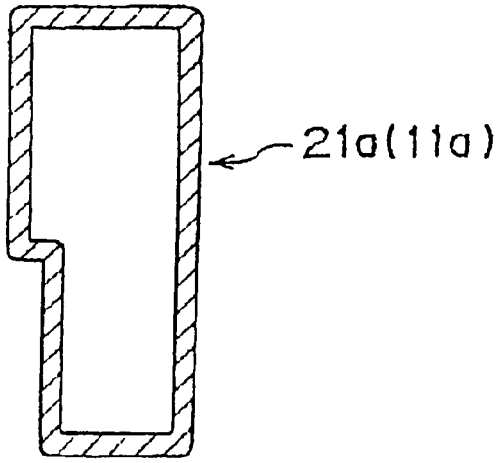
FIGS. 9(*a*) and 9(*b*) are horizontal sectional views of the protrusions provided at the corners of the top and bottom pads.
Figure 9B:
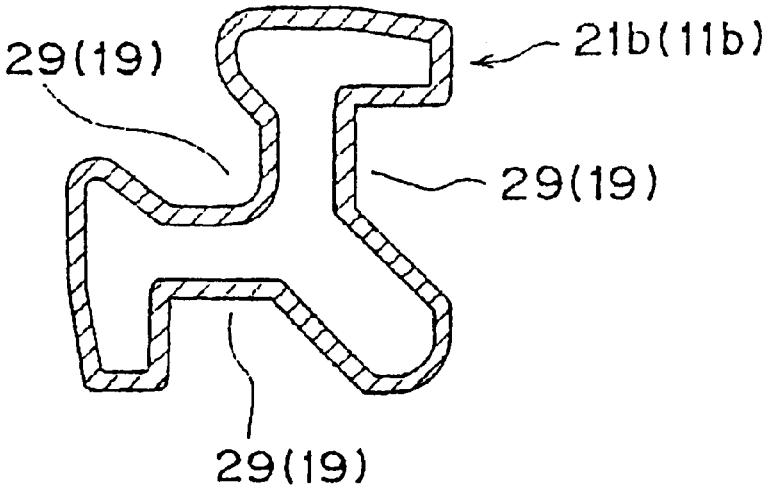

As shown in FIG. 9(*a*), the protrusions 11*a,* provided at the corners of one of the short sides of the top pad 10, and the protrusions 21*a,* provided at the corners of one of the short sides of the bottom pad 20, are formed into a simple, substantially L shape when viewed in a plane; and as shown in FIG. 9(*b*) the protrusions 11*b,* provided at the corners of the other short side of the top pad 10, each have vertical grooves 19 at side surfaces thereof, and the protrusions 21*b,* provided at the corners of the other short side of the bottom pad 20, each have vertical grooves 29 at side surfaces thereof, so that the protrusions 11*b* and 21*b* have a complicated, odd shape when viewed in a plane.

Since the additional box 70 is accommodated adjacent to the protrusions 11*a* of the pad 10 and the protrusions 21*a* of the pad 20, the impact force, which acts, as indicated by arrows $P_1$ in FIG. 7, on the corners where the protrusions 11*a* and 21*a* adjacent to the packaging box 60 are formed, is absorbed by the additional box 70, thereby reducing the amount of impact force acting on the protrusions 11*a* and 21*a.*

Accordingly, the protrusions 11*a* and 21*a* are formed into a simple, substantially L shape, so that they are not very rigid, and thus can absorb as much small impact forces as possible, thereby not allowing the impact forces to reach the item 40.

Unlike the protrusions 11*a* and 21*a,* the protrusions 11*b* of the pad 10 and the protrusions 21*b* of the pad 20 are formed close to corners of the packaging box 60. Therefore, the impact force, acting on the corners where the protrusions 11*b* and 21*b* in the packaging box 60 are formed, act directly on the protrusions 11*b* and 21*b,* as shown by arrows $P_2$ of FIG. 7.

Therefore, the protrusions 11*b* and 21*b* are formed into a complicated, odd shape, with the transverse sectional area (horizontal sectional area) of the walls where the protrusions 11*b* and 21*b* are formed being large. Although this makes the protrusions 11*b* and 21*b* more rigid, making it easier for small impact forces to be transmitted thereto, this makes them harder to break, making it possible to protect the item 40 from large impact forces.

Marks (not shown) are provided at the inside center portion of the top and bottom pads 10 and 20 in order to allow anyone to identify pads. The marks can eliminate the problem of a user placing the top pad 10 at the bottom and the bottom pad 20 at the top.

Figure 10:
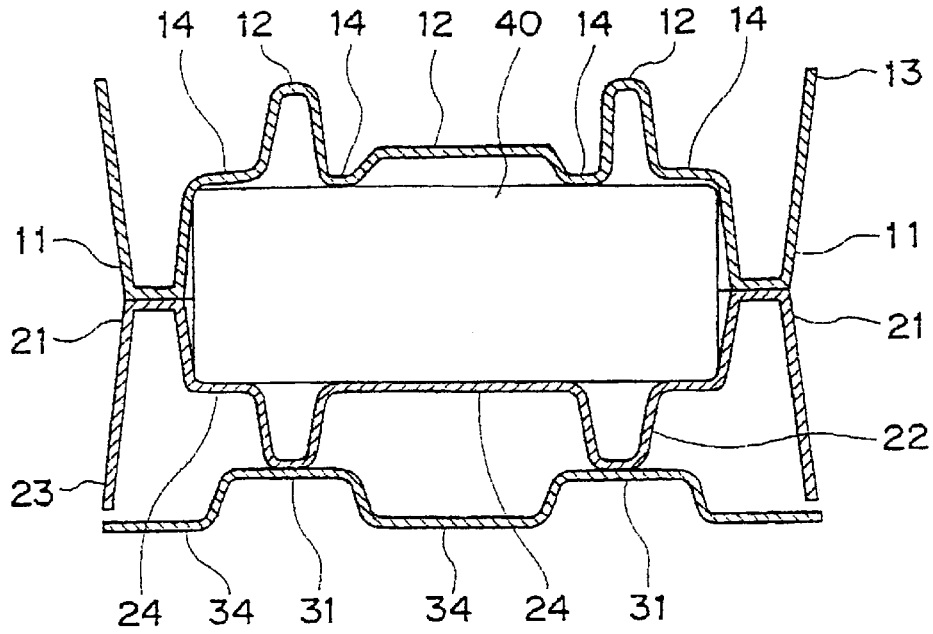
FIG. 10 is a sectional view of pads, whose forms are different from those of the pads of FIG. 3, within which an item is packed.

FIG. 10 illustrates the pads used in another embodiment of the present invention, and corresponds to FIG. 3 illustrating the pads used in the first embodiment of the present invention. The difference between the pads of FIGS. 3 and 10 is that the pads of FIG. 10 do not have flat portions 14 between their respective protrusions 11 and their respective recesses 12 and between their respective protrusions 21 and their respective recesses 22. In both cases, the longitudinal direction (or horizontal direction along the plane of FIG. 10) of the protrusions 31 is substantially perpendicular to the longitudinal direction (vertical direction along the plane of FIG. 10) of their respective recesses 22.

Figure 11:
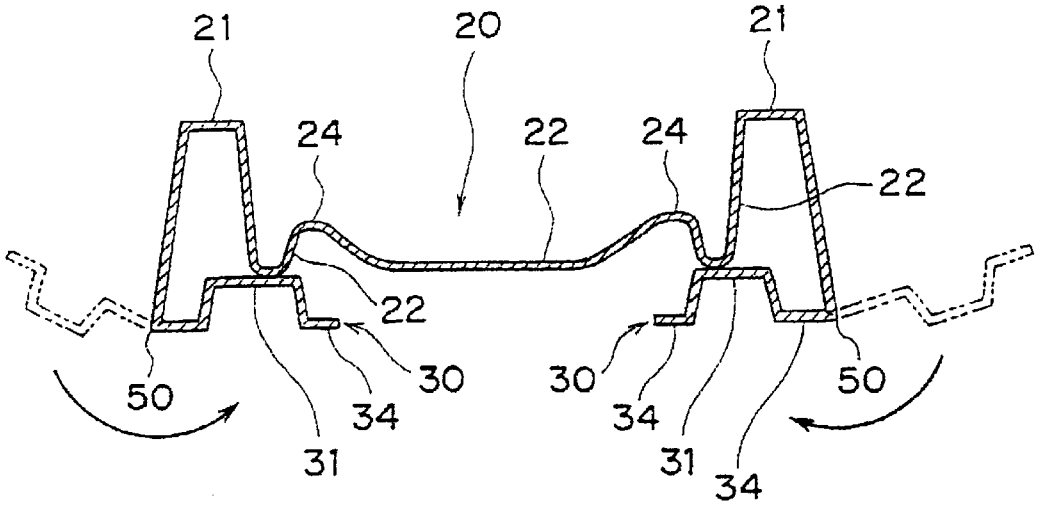
FIG. 11 illustrates an integral structure of the bottom pad 20 and the reinforcing pad 30.

FIG. 11 illustrates the bottom pad 20 and the reinforcing pad 30 formed into an integral structure, in which the reinforcing pad 30 is formed by cutting out the center portion of the reinforcing pad 30 shown in FIG. 3, and the resulting portions of the reinforcing pad 30 are joined to the ends of the bottom pad 20 through hinges 50. When this type of integral structure is used, it is possible to use fewer parts.

Figure 12:
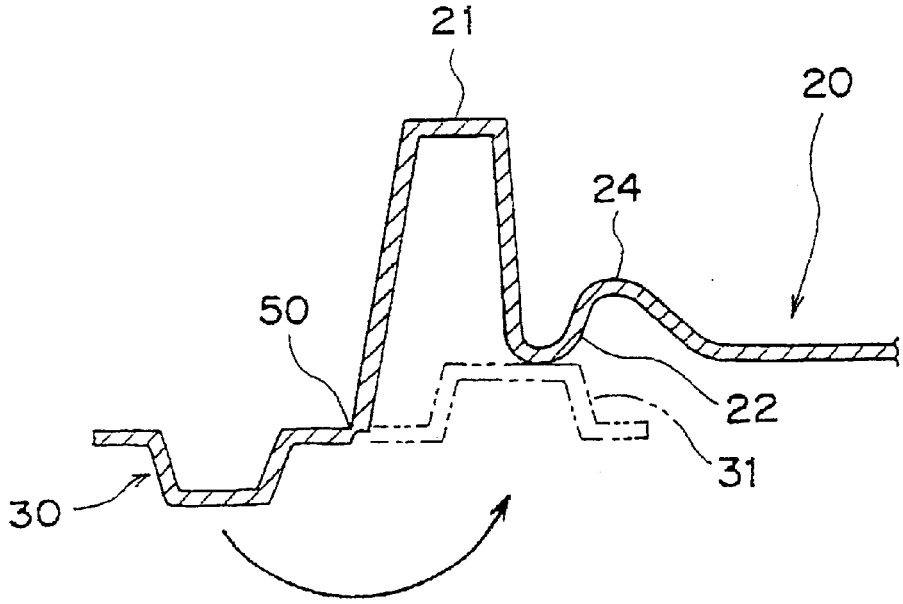
FIG. 12 is a sectional view of the integral structure of the bottom pad and the reinforcing pad.

More specifically, as shown in FIG. 12, the bottom pad and the reinforcing pad, which are formed continuously through the hinges 50 at the outer sides of the bottom pad 20, are molded into an integral structure. When, as indicated by the phantom lines in FIG. 12, the portions, formed by cutting, of the reinforcing pad 30 are bent inwards at the locations where the hinges 50 are formed, the integral structure takes the form shown in FIG. 11.

The hinges 50 may have a thin-walled structure, as shown in FIG. 12, or a structure containing perforations formed at a predetermined pitch.

Figure 13:
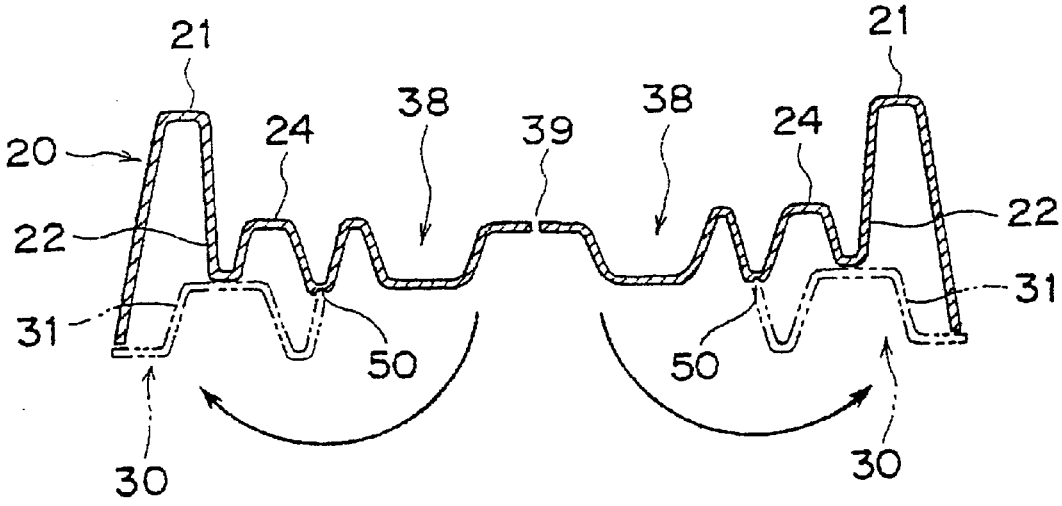
FIG. 13 illustrates another integral structure of the bottom pad 20 and the reinforcing pad 30.

Like the structure illustrated in FIG. 11, the structure shown in FIG. 13 is an integral structure of the bottom pad 20 and the reinforcing pad 30, wherein tongue-shaped areas 38, surrounded by a slit 39 with a U shape when viewed in a plane, are formed in the bottom surface wall of the bottom pad 20. When the tongue-shaped areas 38 are bent, as indicated by phantom lines in FIG. 13, at their respective hinges 50, a structure is formed, which can support the recesses 22 of the bottom pad 20 by their respective protrusions 31 of the reinforcing pad 30 as the tongue-shaped areas 38, from below the recesses 22.

Although engineering plastics such as polypropylene (PP) or polyethylene teraphtalate (PET), may be used as pad material in the above-described embodiments, it is preferable, from the point of view of environmental protection, to use pulp mold which can be easily recycled or disposed of In order to increase pad strength, it is preferable to use pulp mold composed of recycled pulp rather than virgin pulp.

In the above-described embodiments, a structure in which a reinforcing pad is placed between the bottom pad and the packaging box has been given as an example. However, when necessary, a structure may be used, in which a reinforcing pad is placed between the top pad and the packaging box such that the recesses of the top pad and the protrusions of the reinforcing pad similarly come into contact with each other. This structure is effective when the packaging box is placed with its top and bottom sides reversed, or when the top pad is dropped with the top pad facing downward.

What is claimed is:

1. A method of packing an item, comprising:

placing the item between a first pad having a plurality of protrusions and a plurality of recesses; and a second pad having a plurality of protrusions and a plurality of recesses; and positioning a third pad having a protrusion which contacts at least one of the plurality of recesses of the second pad, opposite to the first pad with reference to the second pad, the protrusion of the third pad being positioned such that the longitudinal direction thereof is substantially perpendicular to the longitudinal direction of the recesses of the second pad.

2. The packing method according to claim 1, the recesses of the second pad being tapered.

3. The packing method according to claim 1, the protrusion of the third pad being tapered.

4. The packing method according to claim 1, the depth of the recesses of the second pad being substantially equal in value to the height of the protrusion of the third pad.

5. The packing method according to claim 1, the depth of the recesses of the second pad being substantially equal in value to the height of the protrusion of the third pad.

6. The packing method according to claim 1, the first, second and third pads being formed of pulp.

7. The packing method according to claim 1, the first, second and third pads being formed of recycled pulp.

8. The packing method according to claim 1, the second pad and the third pad being formed continuously through a hinge.

9. A package, comprising:

a first pad having a plurality of protrusions and a plurality of recesses;

a second pad having a plurality of protrusions and a plurality of recesses, an item to be packed being placed between the first and second pads; and a third pad having a protrusion which contacts at least one of the plurality of recesses of the second pad, is positioned opposite to the first pad with reference to the second pad, the protrusion of the third pad being positioned such that the longitudinal direction thereof is substantially perpendicular to the longitudinal direction of the recesses of the second pad.

10. The package according to claim 9, the recesses of the second pad being tapered.

11. The package according to claim 9, the protrusion of the third pad being tapered.

12. The package according to claim 9, the depth of the recesses of the second pad being substantially equal in value to the height of the protrusion of the second pad.

13. The package according to claim 9, the depth of the recesses of the second pad being substantially equal in value to the height of the protrusion of the second pad.

14. The package according to claim 9, the first, second, and third pads being formed of pulp.

15. The package according to claim 9, the first, second and third pads being formed of recycled pulp.

16. The package according to claim 9, the second pad and the third pad being formed continuously through a hinge.

* * * * *